US005144714A

United States Patent [19]

Mori et al.

[11] Patent Number: 5,144,714

[45] Date of Patent: Sep. 8, 1992

[54] VACUUM CLEANER

[75] Inventors: Hiroshi Mori, Yokaichi; Seizo Hayashi, Omihachiman; Hiroshi Hayakawa, Shiga; Tomomi Mitani, Yokaichi, all of Japan

[73] Assignee: Matsushita Electric Industrial Co., Ltd., Osaka, Japan

[21] Appl. No.: 657,059

[22] Filed: Feb. 19, 1991

[30] Foreign Application Priority Data

Feb. 22, 1990 [JP] Japan ..... 2-41771

[51] Int. Cl.[5] ..... A47L 9/28

[52] U.S. Cl. ..... 15/319; 15/339; 15/412; 73/861.41

[58] Field of Search ..... 15/319, 339, 412, 377; 73/861.41

[56] References Cited

U.S. PATENT DOCUMENTS

| | | | |
|---|---|---|---|
| 3,199,138 | 8/1965 | Nordeen . | |
| 4,199,839 | 4/1980 | Martinec | 15/377 |
| 4,601,082 | 7/1986 | Kurz | 15/319 |
| 4,767,213 | 8/1988 | Hummel | 15/339 X |
| 4,937,912 | 7/1990 | Kurz | 15/339 |
| 4,942,640 | 7/1990 | Hayashi et al. | 15/339 X |
| 5,023,973 | 6/1991 | Tsuchida et al. | 15/319 |

FOREIGN PATENT DOCUMENTS

| | | | |
|---|---|---|---|
| 0347223 | 12/1989 | European Pat. Off. . | |
| 2336758 | 3/1974 | Fed. Rep. of Germany | 15/319 |
| 2900433 | 6/1980 | Fed. Rep. of Germany . | |
| 3431175 | 8/1985 | Fed. Rep. of Germany . | |
| 1214324 | 8/1989 | Japan . | |
| 1285236 | 11/1989 | Japan . | |
| 1299525 | 12/1989 | Japan . | |

*Primary Examiner*—Chris K. Moore

*Attorney, Agent, or Firm*—Stevens, Davis, Miller & Mosher

[57] ABSTRACT

A vacuum cleaner introduces dust, as well as air, from a nozzle connected with the distal end of a hose into a dust collecting section in the cleaner body through an intake section, while detecting, by means of a detector, the volume of dust being introduced, and controls the output of an electric blower in accordance with the detected volume. One end of the intake section is connected with the proximal end of the hose, while the other end projects into the dust collecting section. Light-emitting and light-receiving elements are provided in the intake section to constitute the detector so as to enable positive detection of dust, easy checking of the contamination of the detector, and easy wiping of the detector.

8 Claims, 8 Drawing Sheets

VACUUM CLEANER

BACKGROUND OF THE INVENTION

1. Field of the Invention

The present invention relates to a vacuum cleaner for industrial or household use.

2. Description of Related Art

A conventional vacuum cleaner of the upright type is disclosed in, for instance, West German Patent Auslegeschrift DE 3431164C2. The disclosed vacuum cleaner is a cylinder-type vacuum cleaner such as that shown in FIG. 6, in which an infrared sensor is employed though its specific construction is not described in detail.

In the case of an upright vacuum cleaner, the dust collected by the cleaner brings forth the condition shown in FIGS. 7 and 8. When a certain amount of dust has been collected in a paper bag 25 fixed to an end portion of an intake section 11 projecting into a dust collecting section 8, it becomes difficult to send air from the intake section 11 into the paper bag 25 so as to flow through the bag 25. On the other hand, the rotation of an electric blower 9 at a certain number of revolutions per unit time causes the air within the dust collecting section 8 to be sent to the outside. Therefore, when the amount of the dust collected increases to a certain amount, the internal pressure within the dust collecting section 8 drops, and the pressure within a passage 35, defined by a member fixed to a position of the section 8 by screws, also drops. A movable member 37 remains motionless while being held in place by a spring 36 disposed in the passage 35 when the internal pressure is above a certain level. However, when the internal pressure becomes lower than this level, the movable member 37 moves compressing the spring 36, so as to allow an inflow of air (indicated by the arrows in FIG. 8) from the outside of the section 8 to the inside thereof. This inflow of air prevents generation of a vacuum within the body of the cleaner, thereby preventing overheating of members such as the motor for the blower, and the resultant deformation of the resin materials used in the cleaner. The movement of the movable member 37 allows the user to be informed of whether the paper bag 25 is filled with dust or not.

A different arrangement is disclosed in DE 3431164C2, in which, as shown in FIG. 6, a detecting means 30 is provided in a handle 17 between a flexible hose 31 extending from a cleaner body 34 and a rigid pipe 32 provided with a suction brush 33 at one end thereof. This is an arrangement applicable to a cylinder-type vacuum cleaner.

Recently, the above-described arrangement of the upright vacuum cleaner has experienced a problem arising from the increase of fibrous dust, such as lint, resulting from changes in the living or working environment. Fibrous dust is, when received in the paper bag 25, bulkier than such dust as earth and sand. Even when fibrous dust fills the paper bag 25 and it has indeed caused a drop in the internal pressure within the dust collecting section 8, the internal pressure does not easily become low enough to cause the movement of the movable member 37. This is because the fibrous dust filling the bag 25 has a lot of voids or vacancies between its specks of dust. If the cleaner in this condition is continuously used, dust will be accumulated in the intake section 11 or in a hose 10. In the end, the vacuum cleaner will not be able to suck dust any more. What is worse is that the dust-filled condition of the cleaner may not be found out until the bag 25 is removed.

Some vacuum cleaners have a sensor employing a light-emitting element and a light-receiving element. These elements are usually protected by a transparent protective cover. However, when substances such as dry sand or earth, or moist fiber, earth or sand have adhered to the cover, the light used in the sensor is blocked by the adhering substance, thereby deteriorating the sensitivity of the sensor. In order to avoid this problem, it is necessary that the sensor is cleaned frequently by, for instance, wiping it with a piece of cloth or the like. However, with the conventional vacuum cleaners, it is impossible to clean the sensor positively and easily because only one side of the sensor can be wiped and because the way the sensor is contaminated cannot exactly be known.

SUMMARY OF THE INVENTION

The presen invention has been accomplished in view of the above-mentioned problems of the prior art. A first object of the present invention is to provide a vacuum cleaner which is, when the bag is filled with dust, capable of reliably informing the user of the dust condition.

A second object of the present invention is to provide a vacuum cleaner which allows a sensor portion to be easily cleaned, and which enables the user to know with ease the way the sensor portion is contaminated.

A third object of the present invention is to provide a vacuum cleaner having a sensor capable of uniformly detecting a amount of dust without being affected by variations in the intensity of the inflow of air from the hose.

A fourth object of the present invention is to provide a vacuum cleaner having a sensor portion which does not easily become contaminated, thereby providing a more accurate sensor operation.

A fifth object of the present invention is to provide a vacuum cleaner in which damage to the lower surface of a nozzle section is prevented.

In order to achieve the first object, according to a first aspect of the present invention, there is provided a vacuum cleaner comprising a cleaner body, a dust collecting section provided in the cleaner body, an intake section projecting into the dust collecting section, a hose connecting a nozzle section rotatably disposed on the suction side of the cleaner body with the dust collecting section through the intake section, a detecting means for detecting dust flowing through the hose, and a control section for controlling the output of an electric blower in accordance with a signal from the detecting means and for indicating the amount of dust on a display section. The detecting means comprises a light-emitting element and a light-receiving element which are provided at mutually opposing positions of the intake section.

In order to achieve the second object, according to a second aspect of the present invention, the intake section comprises a first tubular member which is straight and a second tubular member which is bent at an angle of approximately 90°, the second tubular member having a lid which can be freely opened and closed.

In order to achieve the third object, according to a third aspect of the present invention, the light-emitting element and the light-receiving element are disposed at mutually opposing positions which are downstream of the bend of the intake section according to the second aspect, and which are substantially normal to the inflow of air from the hose.

In order to achieve the fourth object, according to a fourth aspect of the present invention, transparent members for protecting the light-emitting element and the light-receiving element are protruded from the inner wall of the associated tubular member of the intake section.

In order to achieve the fifth object, according to a fifth aspect of the present invention, the nozzle section has a lower surface made of a resin, the lower surface being provided with sheet-metal protector members at least on the portion thereof that is to be brought into contact with a floor surface.

According to the first aspect directed to achieving the first object, since a sensor section is provided in the intake section connected with the dust collecting section, when dust already filling the dust collecting section enters the intake section, this dust condition is immediately detected by the sensor so that the user can be reliably informed of the condition.

According to the second aspect directed to achieving the second object, when the sensor section is contaminated, it can be easily cleaned by either removing the paper bag or opening the lid openably provided on the second tubular member, that is, from either the front or back side of the intake section. Further, since light can enter from either side, the user can know with ease the way the sensor section is contaminated.

According to the third aspect directed to achieving the third object, the light-emitting and light-receiving elements are provided at a location at which variations in the inflow of air caused by variations in the suction force are at their minimum. Therefore, the sensor section is capable of invariably detecting an amount of dust without being affected by variations in the intensity of the inflow of air from the hose.

According to the fourth aspect directed to achieving the fourth object, the protecting members protecting the light-emitting and light-receiving elements are slightly protruded from the inner wall of the first tubular member. This allows some of the dust sucked up and flowing toward the dust-collecting section to impinge against the protecting members, thereby removing any dust adhering to the protecting members. Therefore, the sensor section is prevented from easily being contaminated.

According to the fifth aspect directed to achieving the fifth object, the protector members provided at least on the portion where the lower surface of the nozzle section contacts the floor surface serve to increase the strength of the lower surface. This makes the lower surface of the nozzle section hardly vulnerable to damage by wear, etc.

DESCRIPTION OF THE PREFERRED EMBODIMENT

Figure 1:
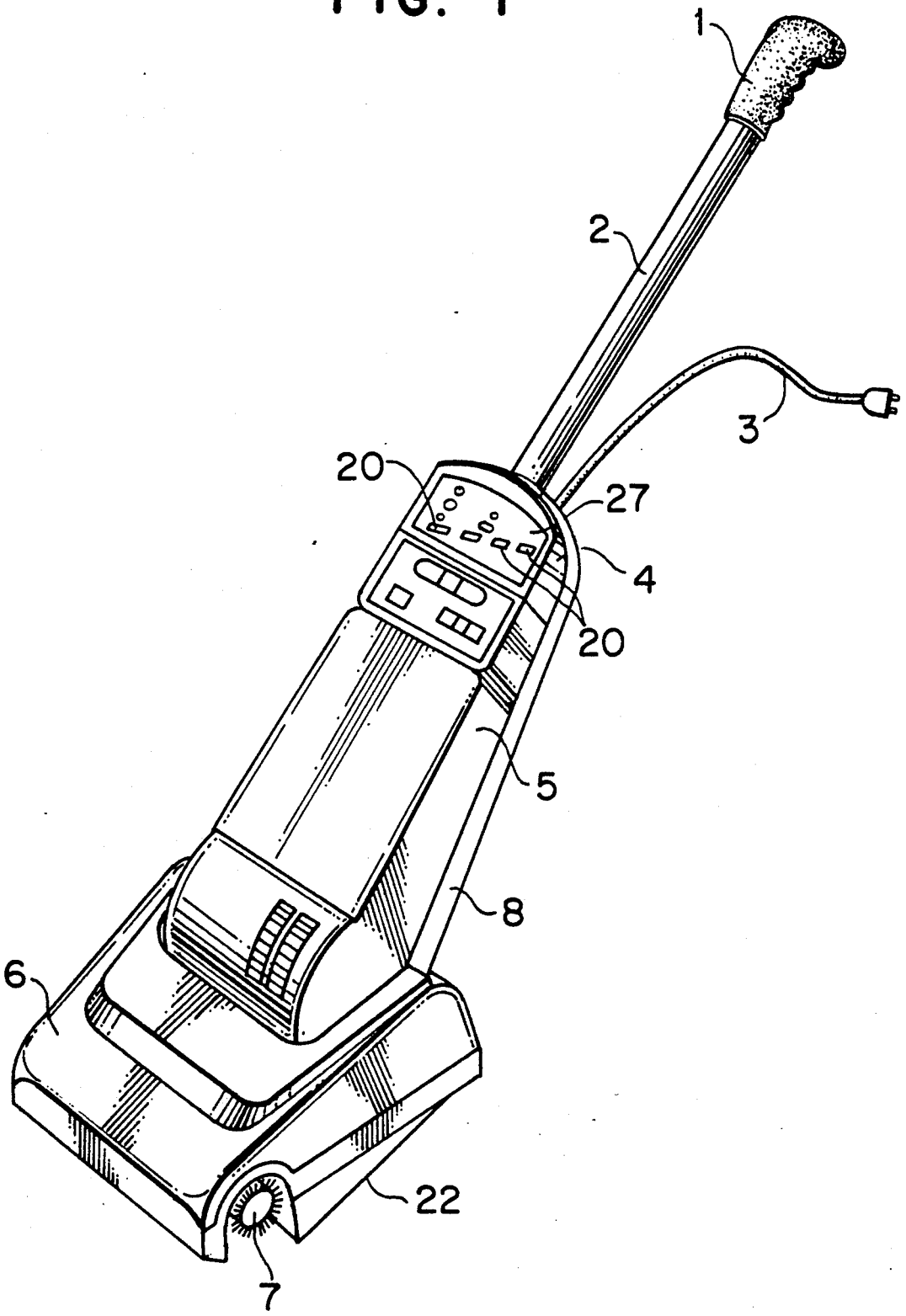
FIG. 1 is a perspective view of a vacuu cleaner according to one embodiment of the present invention.
Figure 2:
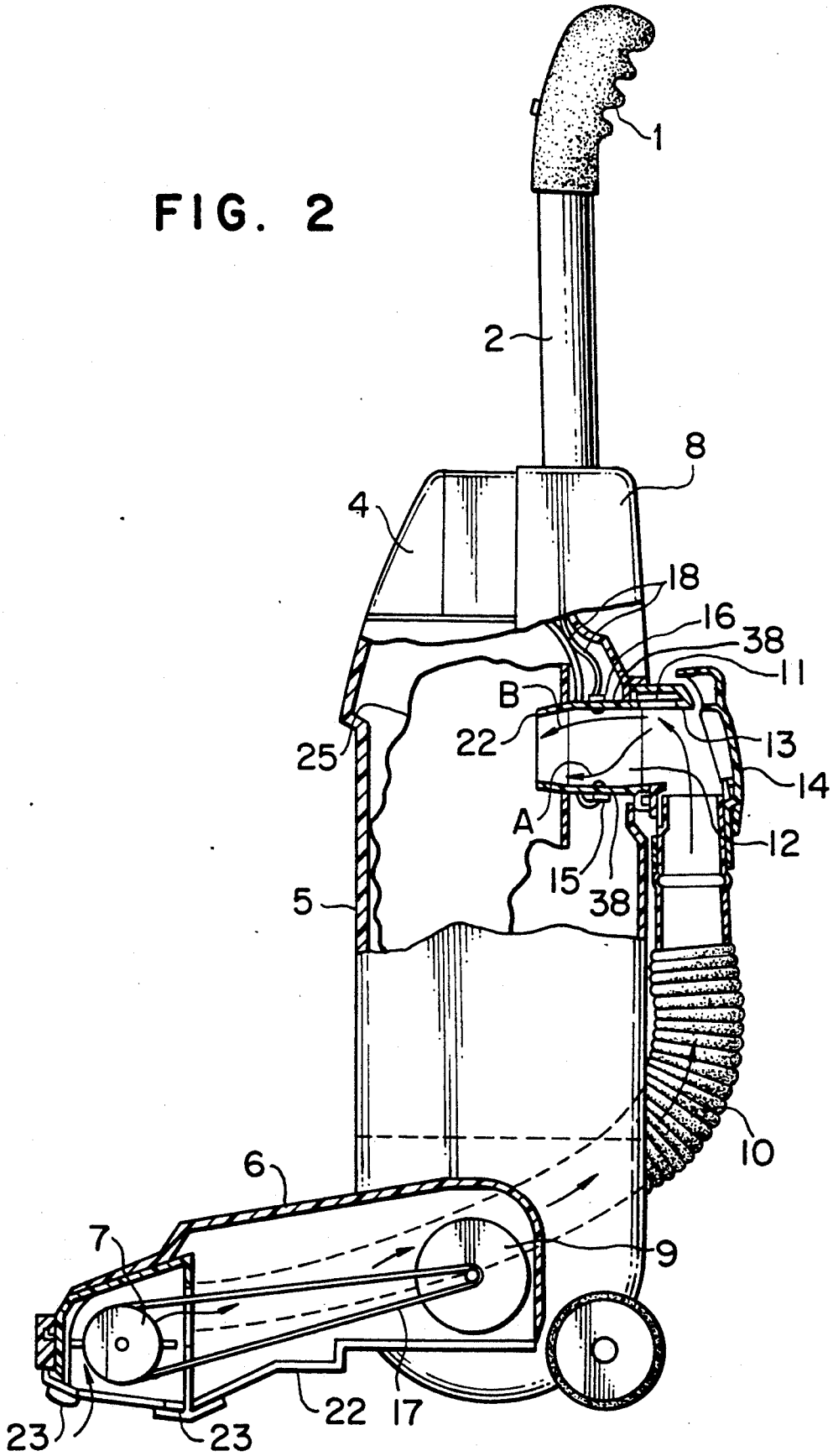
FIG. 2 is a vertical sectional view of the vacuum cleaner.

Referring to FIGS. 1 and 2, a vacuum cleaner according to the present invention has a handle 2 with a grip 1, and a power supply cord 3. A cleaner body includes a dust collecting section 8 accommodating a paper bag 25, and two covers defining the front surface of the cleaner body, namely, an upper cover 4, and a cover 5 for the dust collecting section 8 which is detachably mounted thereon.

A nozzle section 6 having a floor nozzle 7 provided therein is positioned on the suction side of the cleaner body and rotatably mounted on a lower portion of the body. An electric blower 9 is rotatably provided, and a belt 17 is provided for transmitting the rotation of the blower 9 to the floor nozzle 7. A hose 10 connects the nozzle section 6 with the dust collecting portion 8.

Figure 3:
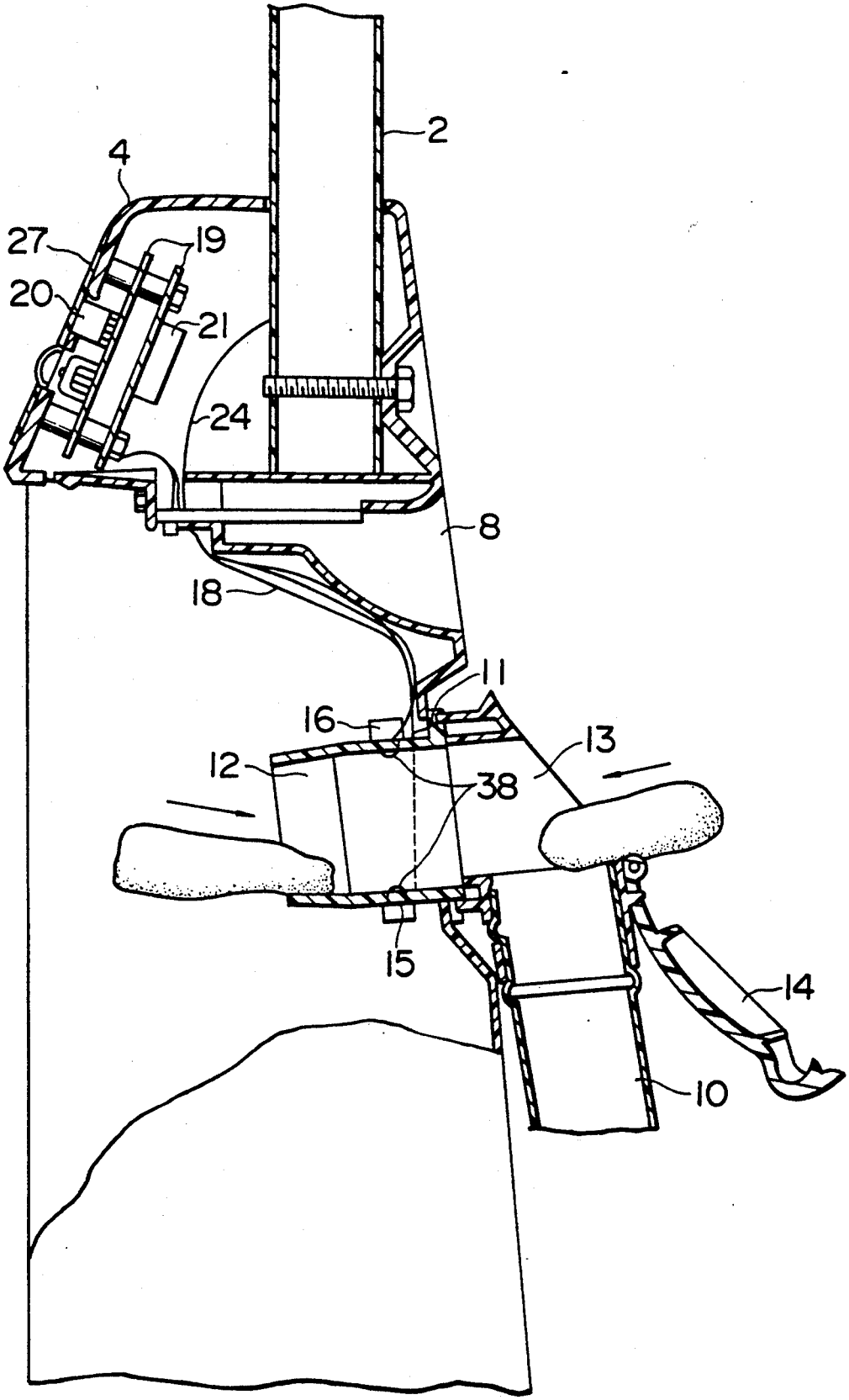
FIG. 3 is a vertical sectional view of the essential parts of the vacuum cleaner.

An intake section 11 projects into the dust collecting section 8, and it comprises a first tubular member 12 and a second tubular member 13. The open end of the paper bag 25 is detachably fixed to the first tubular member 12. The second tubular member 13 is connected to the proximal end of the hose 10. The member 13 is bent at approximately 90°, and it has, on an outer wall thereof, a lid 14 which can be freely closed (as shown in FIG. 2) and opened (as shown in FIG. 3). A detecting means 38 comprising a light-emitting element 15 and a light-receiving element 16 is provided in the intake section 11, more specifically, on the first tubular member 12.

Figure 4:
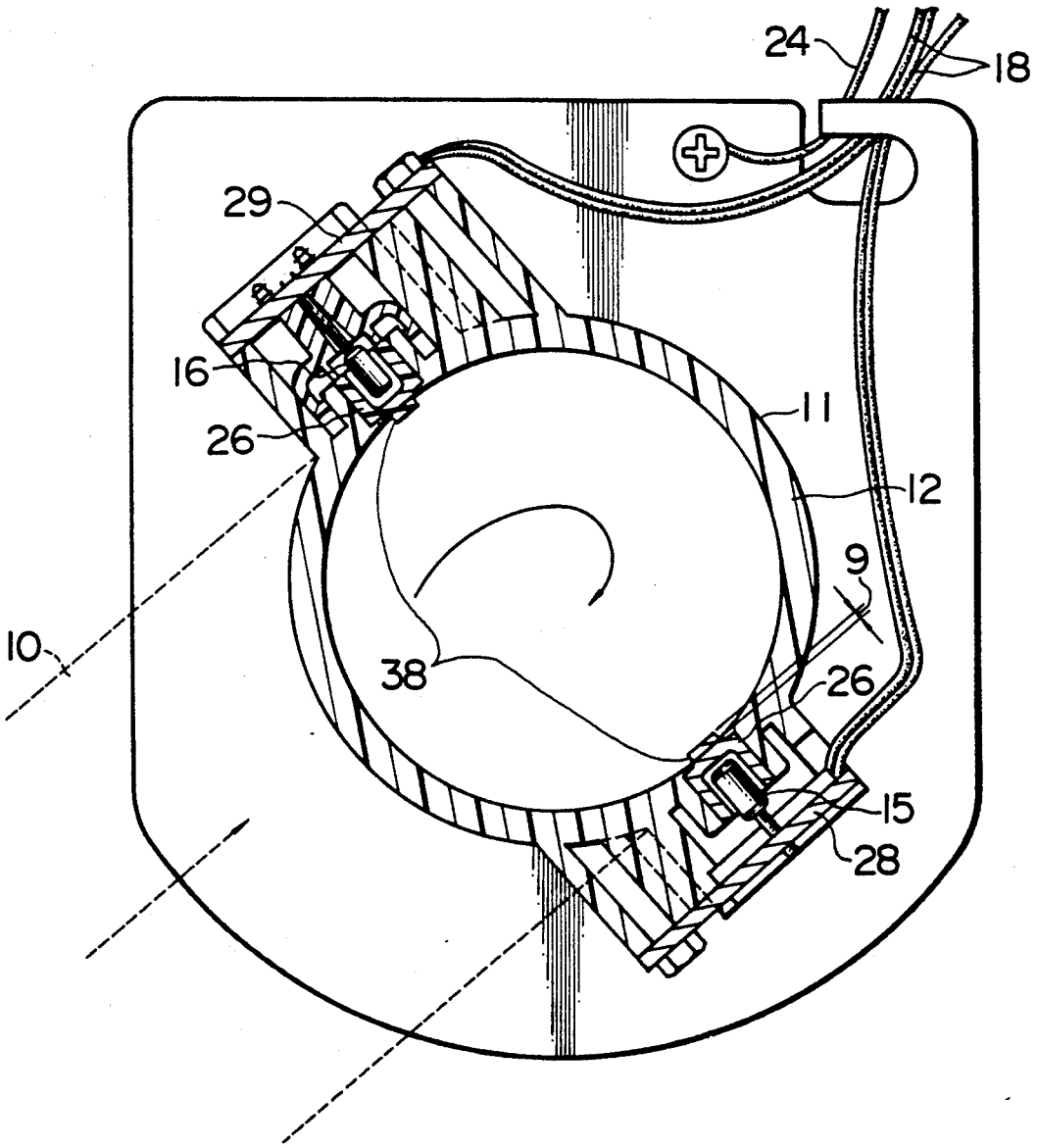
FIG. 4 is an enlarged, front sectional view of some of the essential parts of the vacuum cleaner.

As best shown in FIG. 3, printed circuit boards 19 with light emitters 20, a control section 21, etc. mounted thereon are provided inside the upper cover 4, and they are connected with the light-emitting and light-receiving elements 15 and 16 by a first group of leads 18. As shown in FIG. 4, transparent protecting members 26 are provided for the light-emitting and light-receiving elements 15 and 16. A second group of leads 24, described later, are extended to the handle 2. A display section 27 is provided on the upper cover 4, as shown in FIG. 3.

Figure 5:
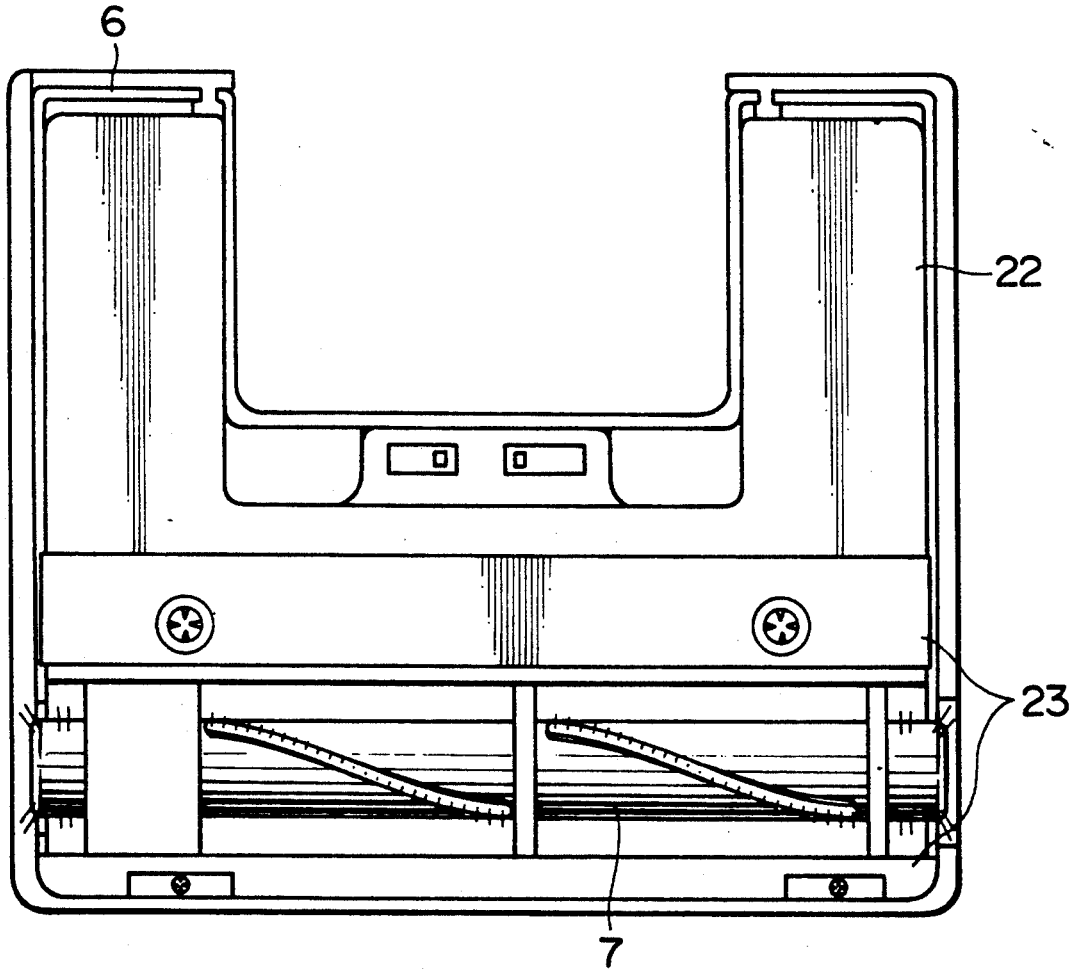
FIG. 5 is a bottom view of a nozzle section of the vacuum cleaner.
Figure 6:
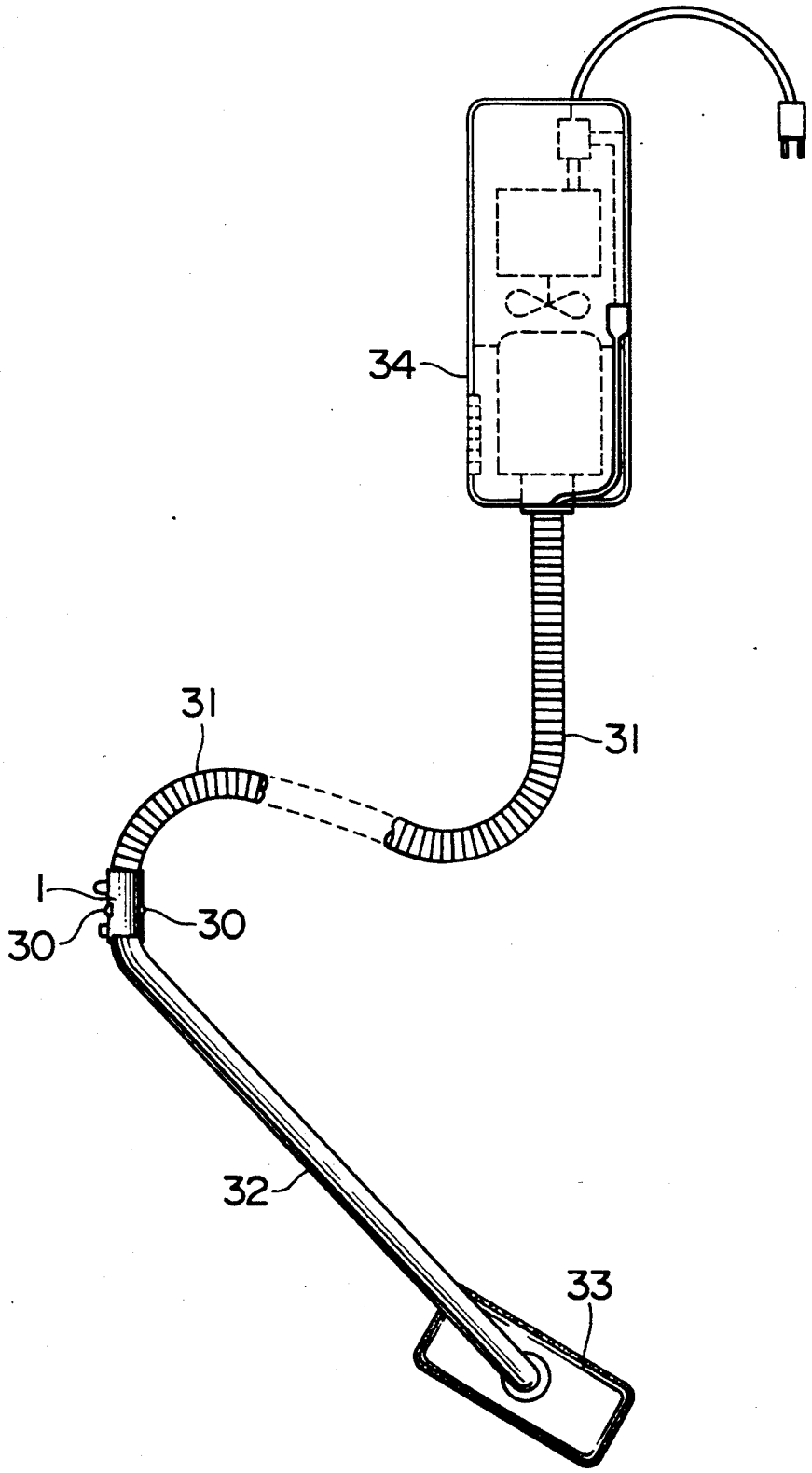
FIG. 6 PRIOR ART
FIG. 6 is a view schematically showing a conventional vacuum cleaner.
Figure 7:
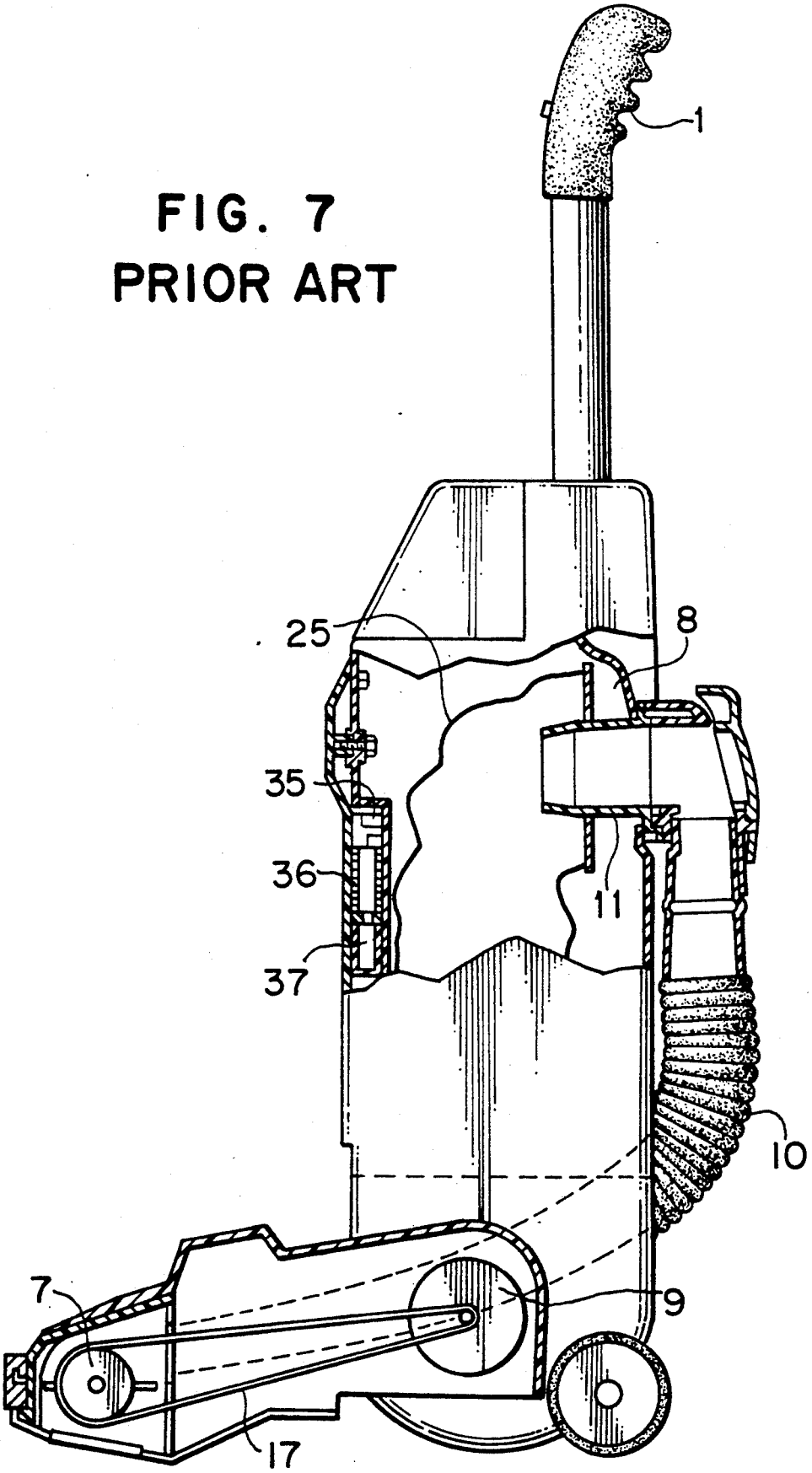
FIG. 7 PRIOR ART
FIG. 7 is a view schematically showing another conventi.onal vacuum cleaner.
Figure 8:
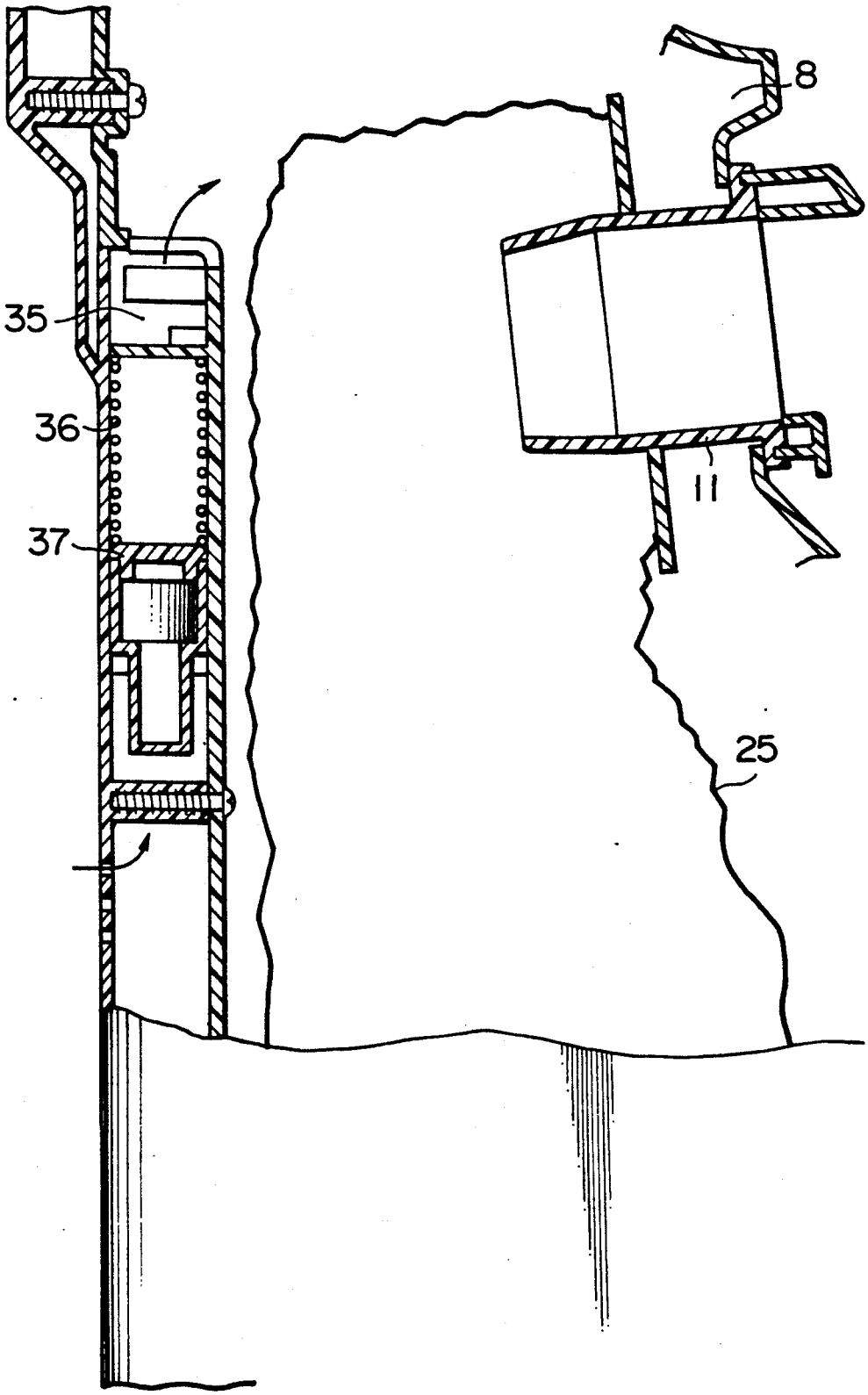
FIG. 8 PRIOR ART
FIG. 8 is a enlarged sectional view of the essential parts of the vacuum cleaner shown in FIG. 7.

As best shown in FIG. 5 the nozzle section 6 includes a reverse cover 22, and sheet-metal protector members 23 fixed to the reverse cover 22 by screws.

The vacuum cleaner having the above-described construction operates in the following manner. When an operation to clean a floor surface is started after the power supply cord 3 is connected to, for instance, an external power source, the electric blower 9 starts to rotate. The shaft of the blower 9 causes, through the belt 17, the floor nozzle 7 of the nozzle section 6 to rotate so that dust on the floor surface is stirred up. The blower 9 causes the air inside the dust collecting section 8 to be discharged to the outside so that the dust stirred up by the floor nozzle 7 is passed through the hose 10 and the intake section 11, then collected into the paper bag 25 within the dust collecting section 8. In this process, the light projected by the light-emitting element 15 is blocked and prevented from reaching the light-receiving element 16 each time a speck of dust crosses the light, whereby the detecting means 38 detects the volume of dust being collected. In accordance with a detected volume of dust, the control section 21 on the printed circuit boards 19 inside the upper cover 4 changes the output of the electric blower 9. Also, the volume of the dust collected is displayed, by light emitters 20, as one of various levels of dust-amount indications on the display section 27. The flow of air is shown by the arrows in FIG. 2.

Referring to FIG. 3, if substances, such as dry earth or sand, or moist fiber or earth, adhere to the members 26 protecting the light-emitting and light-receiving elements 15 and 16, the light projected from the light-emitting element 15 can be blocked by the adhering substances. In such cases, even when dust crosses the projected light, the dust may not be correctly detected by detecting the size or the number of the specks of dust. It is necessary, therefore, that the transparent protecting members 26, which are provided on the inner wall of the first tubular member 12 of the intake section 11, are wiped with cloth or the like. For this purpose, the dust collecting section cover 5 is opened, and the paper bag 25 is removed. At this time, if the lid 14 provided on the second tubular member 13 is also openeq, the user can exactly know the way the contamination has taken place, and further members 26 can be wiped not only via an opening of the first tubular member 12 but also via an opening of the second tubular member 13, as shown in FIG. 3. Because light can enter from the two openings in the intake section 11, the contamination of the sensor section can be observed more easily than in the case of the conventional cleaners. A wiping operation may be performed during a cleaning operation when the sensitivity is found to be dull. If the lid 14 is opened in order to perform such wiping, the contaminating substances can be wiped off without removing the cover 5 and the paper bag 25.

When the paper bag 25 is filled with fibrous dust, with a part of the dust reaching the light-emitting and light-receiving elements 15 and 16 on the first tubular member 12 of the intake section 11, the light projected by the element 15 toward the element 16 is always blocked by a part of the dust. Also, in this case, some of the dust moves in an uncertain manner under the suction force. Therefore, this condition can be identified as a condition in which a lot of dust is there within the cleaner. The control section 21 operates in such a manner as to cause, if the detection of the same number of specks of dust, and the same size of dust, is repeated for a certain period of time, the light emitters 21 to display an indication of a bag-filled condition, and stop the electric blower 9, thereby enabling the user to be informed of the condition. When the paper bag 25 is filled with earth and sand sucked up, this condition can be determined in a similar manner because, in this case also, the light projected by the element 15 does not reach the opposing element 16. A similar indication is displayed when the protecting members 26 are soiled, thereby making it possible to positively inform the user of a condition requiring a sensor cleaning. When the hose 10 is clogged with foreign matter, the light projected by the element 15 continues to reach the other element 16, while dust continues not to be detected. Therefore, this condition can be determined and displayed in a similar manner.

The first tubular member 12 of the intake section 11 is made of an electrically conductive material so that the light-emitting and light-receiving elements 15 and 16 will not be charged with static electricity generated when dust is sucked up. Also, the second group of leads 24 are extended from the first tubular member 12 to the handle 2 which is made of a metal material. If the grip 1, screwed onto the handle 2, is also made of an electrically conductive material, the static electricity generated in the intake section 11 is allowed to escape to the person holding the grip 1, thereby preventing erroneous operation of the control section 21 which can be caused by static electricity.

Referring to FIGS. 2 and 5, the reverse cover 22 used on the lower surface of the nozzle section 6 is made of a resin material for the following reason. Conventionally, such a reverse cover has been a sheet-metal member. With this construction, although it is necessary that a wide bristle portion is provided on the floor nozzle 7 in order to have the nozzle 7 cover a large area of a floor surface, it is sometimes impossible to form, in a sheet-metal member, a narrow portion permitting a wide bristle portion. However, forming the cover 22 with only a resin material involves the risk of friction occurring between the resin cover and the floor surface as well as the risk of the resin cover being abraded or worn by metal members such as screws. In order to avoid these risks, a certain portion of the lower surface of the nozzle section 6 which contacts the floor surface is formed as the sheet-metal protector members 23.

Referring to FIG. 4, the light-emitting element 15 and the light-receiving element 16 are mounted on printed circuit boards 28 and 29, respectively. The hose 10, indicated by the broken lines in FIG. 4, extends from the nozzle section 6 to the intake section 11, and air flows through the hose 10 and the section 11, as indicated by the broken-line arrow and the solid-line arrow, respectively. The second tubular member 13, which is bent at approximately 90° as viewed from a side (as shown in FIG. 2), is connected with the hose 10 heading from an obliquely downward position to the intake section 11 (as shown in FIG. 4). Let us now consider the flow of air through these members. It is considered that air flowing in the hose 10 is advancing at the same speed throughout the hose 10. When the air flows into the first tubular member 12 of the intake section 11 after the air flow has been bent approximately by 90°, the flow of air is changed in various ways. When the suction force is strong, the air collides against the inner wall of the second tubular member 13 approximately normally bent, then advances while forming a turbulent flow, as indicated by the arrow A in FIG. 2. When the suction force is weak, there is not much turbulence, and the air flows along the bend of the second tubular member 13 into the first tubular member 12, as indicated by the arrow B. Thus, th flow of air is varied by variations in the suction force. The variations in the air flow are considered to occur at the maximum level in the direction in which the hose 10 is headed to the second tubular member 13 of the intake section 11, that is, the direction indicated by the broken-line arrow in FIG. 4. Therefore, if the light-emitting and ight-receiving elements 15 and 16 are provided at positions normal to this particular direction, their operation is not severely affected by whether the suction force is strong or weak. With this arrangement, it is also possible to prevent the detection elements 15 and 16 from easily being contaminated.

The transparent members 26 for protecting the light-emitting and light-receiving elements 15 and 16 protrude from the inner surface of the first tubular member 12 of the intake section 11 for the following reason. Even when dust such as powdery dust or fiber wet with water adheres to the protecting members 26, this arrangement of the members 26 allows fibrous dust such as lint sucked up under the suction force of the cleaner to impinge against the protecting members 26, thereby removing the adhering substances. However, if the dimension by which the members 26 are protruded exceeds the value a shown in FIG. 4, this may lead to clogging with foreign matter. The allowable upper limit of protrusion is considered to be 1 mm. Dimensions equal to or less than 1 mm are advantageous in that, even if hard substances, such as a piece of metal, have been sucked up, the dust is not considered to cause serious damage although it strikes an edge of the protruded portion. There is little possibility of metal dust, which is relatively heavy impinging against the protruded portions because it is considered that, when such dust advances in the curved hose 10, the dust tends to move radially inward toward the axial center of the hose 10. However, should protecting members 26 be formed therein with recessed surfaces, it would be disadvantageous in that dust may be trapped in the recesses. The trapped dust may not be removed from the members 26 even when fibrous dust, such as lint, is sucked up later. Removing the trapped dust by a manual operation can also be difficult.

As described above, the present invention provides the following effects:

(1) A vacuum cleaner has a dust collecting section in the cleaner body, an intake section projecting into the dust collecting section, a hose connecting the nozzle section rotatably disposed on the suction side of the cleaner body with the dust collecting section through the intake section, a detecting means for detecting dust flowing in the hose, and a control section for controlling the output of an electric blower in accordance with a signal from a detecting means and for indicating the amount of dust on a display section. The detecting means comprises a light-emitting element and a light-receiving element which are provided at mutually opposing positions of the intake section. Since a sensor section is provided in the intake section connected with the dust collecting section, when dust already filling the dust collecting section enters the intake section, this dust condition is immediately detected by the sensor so that the user can be reliably informed of the condition.

(2) The intake section comprises a first tubular member which is straight and a second tubular member which is bent at an angle of approximately 90°, the second tubular member having a lid which can be freely opened and closed. When the sensor section is contaminated, it can be easily cleaned by either removing the paper bag or opening the openable lid on the second tubular member, that is, from either the front or back side of the intake section. Further, since light can enter from either side, the user can know with ease the way the sensor section is contaminated.

(3) With the construction under Item (2), the light-emitting element and the light-receiving element are disposed at mutually opposing positions which are downstream of the bend, and which are substantially normal to the inflow of air from the hose. Since these elements are provided at a location at which variations in the inflow of air caused by variations in the suction force are at their minimum, the sensor section is capable of uniformly detecting an amount of dust without being affected by variations in the intensity of the inflow of air from the hose.

(4) The light-emitting and light-receiving elements are protected by transparent protecting members which are protruded from the inner wall of the associated tubular member of the intake section. This allows some of the dust sucked up and flowing toward the dust-collecting section to strike against the protecting members, thereby removing any dust adhering to the protecting members. Therefore, the sensor section is prevented from easily being contaminated.

(5) The nozzle section has a lower surface made of a resin and provided with sheet-metal protector members at least on the portion thereof that is to be brought into contact with a floor surface. This makes the lower surface of the nozzle section hardly vulnerable to damage by wear, etc.

What is claimed is:

1. A vacuum cleaner comprising: a cleaner body; a dust collecting section provided in said cleaner body; an intake section projecting into said dust collecting section; a hose connecting a nozzle section rotatably disposed on a suction side of said cleaner body with said dust collecting section through said intake section, said intake section comprising a first tubular member having a longitudinal axis extending substantially straight in a first direction, having an inner wall and connected to said dust collecting section, and a second tubular member connected at one end to said hose and at another end to said first tubular member and having a longitudinal axis extending substantially straight in a second direction which is oriented at an angle with respect to said first direction; a detecting means for detecting dust flowing in said hose, said detecting means comprising a light-emitting element and a light-receiving element which are provided at mutually opposing positions along said inner wall of said first tubular member, wherein a straight line, which passes through both said opposing positions, extends substantially orthogonal to said second direction; and a control section for controlling an output of an electric blower in accordance with a signal from said detecting means and for indicating an amount of said dust flowing in said hose on a display section.

2. A vacuum cleaner comprising: a cleaner body; a dust collecting section provided in said cleaner body; an intake section projecting into said dust collecting section; a hose connecting a nozzle section rotatably disposed on a suction side of said cleaner body with said dust collecting section through said intake section; a detecting means for detecting dust flowing in said hose, said detecting means comprising a light-emitting element and a light-receiving element which are provided at mutually opposing positions of said intake section; and a control section for controlling an output of an electric blower in accordance with a signal from said detecting means and for indicating an amount of said dust flowing in said hose on a display section, said detecting means being provided ins aid intake section; and transparent members for protecting said light-emitting element and said light-receiving element, the protecting members being disposed to protrude from the inner wall of the second tubular member of said intake section.

3. A vacuum cleaner according to claim 1 wherein said nozzle section has a lower surface made of resin, the lower surface being provided with sheet-metal protector members at least on a portion thereof that is to be brought into contact with a floor surface.

4. A vacuum cleaner comprising: a cleaner body; a dust collecting section provided in said cleaner body; an intake section projecting into said dust collecting section; a hose connecting a nozzle section rotatably disposed on a suction side of said cleaner body with said dust collecting section through said intake section, said intake section comprising a first tubular member having an inner wall and connected to said dust collecting section, and a second tubular member connected at one end to said hose and at another end to said first tubular member at an angle wtih respect thereto; a detecting means, attached on said inner wall of said first tubular member, for detecting dust flowing in said hose; a lid member for opening and closing an access opening formed in said second tubular member; and a control section for controlling an output of an electric blower in accordance with a signal from said detecting means and for indicating an amount of dust flowing in said hose on a display section.

5. A vacuum cleaner according to claim 4, further comprising transparent members for protecting said light-emitting element and said light-receiving element, the protecting members being protruded from the inner wall of the first tubular member of said intake section.

6. A vacuum cleaner according to claim 4, wherein said nozzle section has a lower surface made of resin, the lower surface being provided with sheet-metal protector members at least on a portion thereof that is to be brought into contact with a floor surface.

7. A vacuum cleaner as set forth in claim 4, wherein said detecting means comprises a light-emitting element and a light-receiving element which are provided along the inner wall of said first tubular member at mutually opposing positions.

8. A vacuum cleaner according to claim 7, further comprising transparent members for protecting said light-emitting element and said light-receiving element, the protecting members being protruded from the inner wall of the first tubular member of said intake section.

* * * * *